US007950170B2

(12) United States Patent
Hall et al.

(10) Patent No.: US 7,950,170 B2
(45) Date of Patent: May 31, 2011

(54) SKEWED ROLLER ON AN EXCAVATOR

(76) Inventors: David R. Hall, Provo, UT (US); Neil Cannon, Provo, UT (US)

( * ) Notice: Subject to any disclaimer, the term of this patent is extended or adjusted under 35 U.S.C. 154(b) by 146 days.

(21) Appl. No.: 12/357,570

(22) Filed: Jan. 22, 2009

(65) Prior Publication Data

US 2010/0107455 A1 May 6, 2010

Related U.S. Application Data

(63) Continuation-in-part of application No. 12/039,510, filed on Feb. 28, 2008, now Pat. No. 7,676,968, which is a continuation-in-part of application No. 11/871,878, filed on Oct. 12, 2007, now Pat. No. 7,681,338, which is a continuation-in-part of application No. 11/748,184, filed on May 14, 2007, now Pat. No. 7,690,138, application No. 12/357,570, which is a continuation-in-part of application No. 12/173,123, filed on Jul. 15, 2008, now Pat. No. 7,854,078.

(51) Int. Cl.
*E02F 9/28* (2006.01)
*E02F 3/14* (2006.01)

(52) U.S. Cl. ..... 37/347; 37/352

(58) Field of Classification Search ..... 37/347, 37/352, 365, 91–97, 364, 446–460, 462–465; 175/426, 428, 432, 227, 365, 370–374; 299/33, 299/40, 55, 56, 110; 405/138, 141
See application file for complete search history.

(56) References Cited

U.S. PATENT DOCUMENTS

| | | | | |
|---|---|---|---|---|
| 3,787,101 | A | 1/1974 | Sugden | |
| 4,035,024 | A | 7/1977 | Fink | |
| 4,189,183 | A | 2/1980 | Borowski | |
| 4,381,038 | A | 4/1983 | Sugden | |
| 4,548,442 | A | 10/1985 | Sugden | |
| 5,074,063 | A | 12/1991 | Vannette | |
| 5,219,380 | A | 6/1993 | Young | |
| 5,295,735 | A | 3/1994 | Cobbs | |
| 5,392,540 | A | 2/1995 | Cooper | |
| RE35,088 | E | 11/1995 | Gilbert | |
| 5,484,191 | A | 1/1996 | Sollami | |
| 5,490,339 | A | 2/1996 | Accettola | |
| 5,655,614 | A * | 8/1997 | Azar | 175/404 |
| 5,785,135 | A | 7/1998 | Crawley | |
| 5,791,825 | A | 8/1998 | Gardner | |
| 5,961,185 | A | 10/1999 | Friant | |
| 6,085,446 | A | 7/2000 | Posch | |
| 6,105,694 | A * | 8/2000 | Scott | 175/428 |
| 6,341,823 | B1 | 1/2002 | Sollami | |
| 6,367,569 | B1 | 4/2002 | Walk | |
| 6,457,267 | B1 | 10/2002 | Porter | |
| 6,543,963 | B2 | 4/2003 | Bruso | |
| 6,779,948 | B2 | 8/2004 | Bruso | |
| 6,854,201 | B1 | 2/2005 | Hunter | |
| 6,944,977 | B2 | 9/2005 | Deniau | |
| 7,150,131 | B2 | 12/2006 | Barker | |

* cited by examiner

*Primary Examiner* — Robert E Pezzuto
(74) *Attorney, Agent, or Firm* — Tyson J. Wilde; Philip W. Townsend, III

(57) ABSTRACT

In one aspect of the invention, a trenching machine has at least one roller assembly comprising a body rotationally supported by an axle exteriorly mounted to a trenching chain or wheel. At least a portion of the body comprises a substantially conical shape.

18 Claims, 9 Drawing Sheets

SKEWED ROLLER ON AN EXCAVATOR

CROSS REFERENCE TO RELATED APPLICATIONS

This application is a continuation-in-part of U.S. patent application Ser. No. 12/039,510, filed Feb. 28, 2008, now U.S. Pat. No. 7,676,968 which is a continuation-in-part of U.S. patent application Ser. No. 11/871,878, filed Oct. 12, 2007, now U.S. Pat. No. 7,681,338 which is a continuation-in-part of U.S. patent application Ser. No. 11/748,184 which was filed on May 14, 2007 now U.S. Pat. No. 7,690,138. This application is also a continuation-in-part of U.S. patent application Ser. No. 12/173,123, filed Jul. 15, 2008, now U.S. Pat. No. 7,854,078. All of these applications are herein incorporated by reference for all that it discloses. The present application claims priority to all of these applications as well.

BACKGROUND OF THE INVENTION

In the trenching industry, earth may be degraded using picks or teeth to break up minerals and rocks. Picks are generally attached to trenching booms or wheels and are used for making trenches in the earth for installing pipes or utility lines and digging foundations for buildings.

U.S. Pat. No. 4,035,024 to Fink, which is herein incorporated by reference for all that is contains discloses a hard rock trench cutting machine including a main body assembly, a cutter wheel assembly, and a longitudinal thrust assembly. The main body assembly includes two longitudinally extending cantilever support booms each having a forward portion and a rearward portion. The rearward portions of the support booms are connected to four side wall support feet which move laterally relative to the support booms between a retracted position and an extended position. The cutter wheel assembly includes a cutter wheel frame slidably disposed on the forward portion of the support booms. A cutter wheel drum carrying a plurality of roller cutters is rotatably carried by the cutter wheel frame for rotation about an axis. The longitudinal thrust assembly extends between the main body assembly and the cutter wheel assembly for pushing the roller cutters against the trench end face.

Examples of the trenching machines of the prior art are disclosed in U.S. Pat. No. 5,961,185 to Friant, U.S. Pat. No. 5,295,735 to Cobbs, U.S. Pat. No. 7,150,131 to Barker, U.S. Pat. No. 6,854,201 to Hunter et al, U.S. Pat. No. 6,457,267 to Porter et al, and U.S. Pat. No. 6,341,823 to Sollami. These applications are herein incorporated by reference for all that they contain.

BRIEF SUMMARY OF THE INVENTION

In one aspect of the invention, a trenching machine has at least one roller assembly comprising a body rotationally supported by an axle exteriorly mounted to a trenching chain or wheel. At least a portion of the body comprises a substantially conical shape.

The roller assembly may comprise at least one metal-to-metal seal assembly disposed on a base end of the axle and intermediate the axle and an inner surface of the body. The seal may comprise a backup ring and an o-ring. The roller assembly may comprise a load carrying bearing assembly disposed intermediate the axle and an inner surface of the body. The bearing assembly may comprise ball bearings, roller bearings, ball-thrust bearings, deep-groove ball bearings, taper roller bearings, roller thrust bearings, or combinations thereof. The bearing assembly may comprise a wear resistant coating disposed on the axle, the inner surface of the body, or combinations thereof. The coating may comprise Mo, Co, Fe—Si, Cr, self-fusing alloys, FeB, Fe—Si, SiC, cemented metal carbides, TiN, nitrides, polycrystalline ceramics, polycrystalline diamond, cubic boron nitride, or combinations thereof.

In some embodiments, the roller assembly may comprise multiple cutting elements radially arranged in multiple rows along an outer surface of the body. The cutting elements may comprise a pointed geometry. The pointed geometry of the cutting element may comprise a substantially conical shape with a round apex. The cutting element may comprise a polycrystalline diamond body bonded to a cemented metal carbide substrate, and the diamond body is thicker than the carbide substrate. At least one of the roller assemblies may be followed by a pick also disposed in the trenching chain. The picks may be adapted to contact the formation after the roller assembly.

The roller assembly may comprise a chevron pattern comprising a plurality of roller assembly disposed in a single link of the trenching chain facing each other. The axle may be positioned at an angle of 25 to 55 degrees with respect to a chain link of the trenching machine. At least one cutting element may protrude out of the body at a different angle than another cutting element on the same body. A rotational axis of the conically shaped body may be skewed. At least two bodies may be skewed with respect to each other.

In another aspect of the invention, a trenching machine may comprise at least one roller assembly comprising a skewed body rotationally supported by an axle exteriorly mounted to a trenching chain or wheel. The body may comprise a substantially conical shape.

For purposes of this disclosure, the term skewed refers to axes of objects that are neither parallel. In some embodiments, the axes are not intersecting. The objects may be considered to be misaligned from each other.

DETAILED DESCRIPTION OF THE INVENTION AND THE PREFERRED EMBODIMENT

Figure 1:
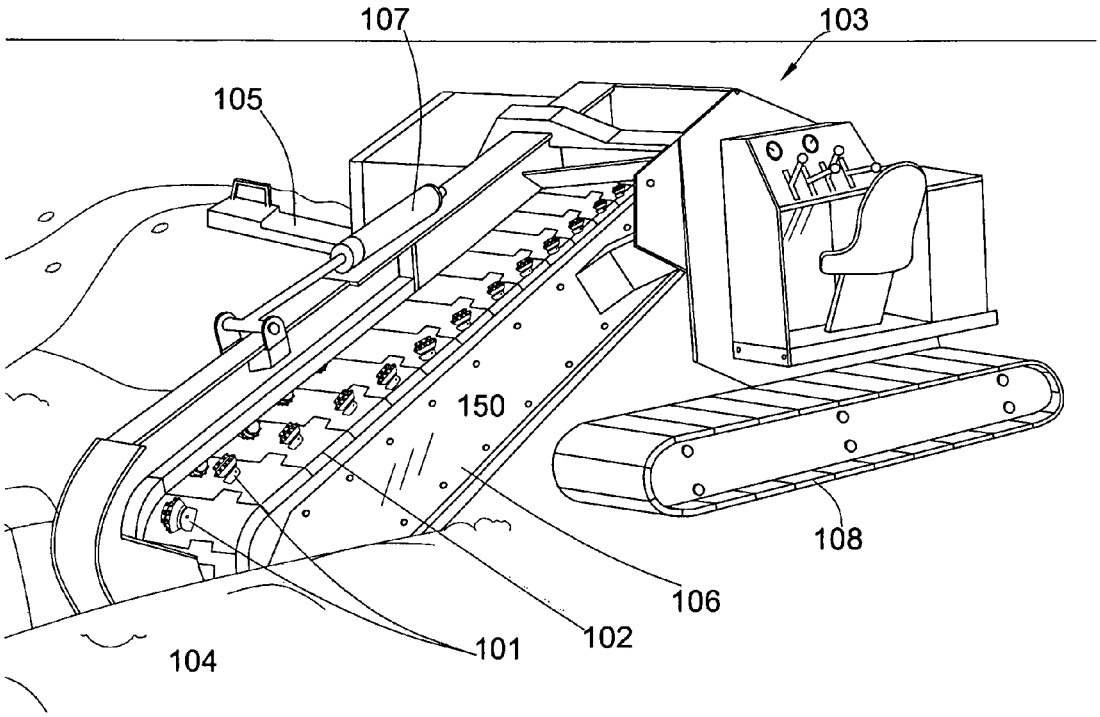
FIG. 1 is a perspective diagram of an embodiment of a plurality of roller assemblies on a trenching machine.

FIG. 1 is a perspective diagram of an embodiment of a plurality of roller assemblies 101 on a rotating chain 102 attached to a motor vehicle 103. The plurality of roller assemblies 101 is exteriorly mounted in a chevron pattern on the chain 102 of a boom 106 to facilitate degradation and removal of the formation 104. The chain 102 rotates in the direction of the arrow 150 and cuts the formation 104 forming a trench while bringing the formation 104 cuttings out of the trench to the conveyor belt 105 which directs the cuttings to a side of the trench. The boom 106 may be raised while the machine is being transported or it may be lowered for trenching as shown in FIG. 1. The position of the boom 106 may be controlled by a hydraulic piston and cylinder 107. The trenching machine may move about the formation 104 by tracks 108, wheels or combinations thereof.

Figure 2:
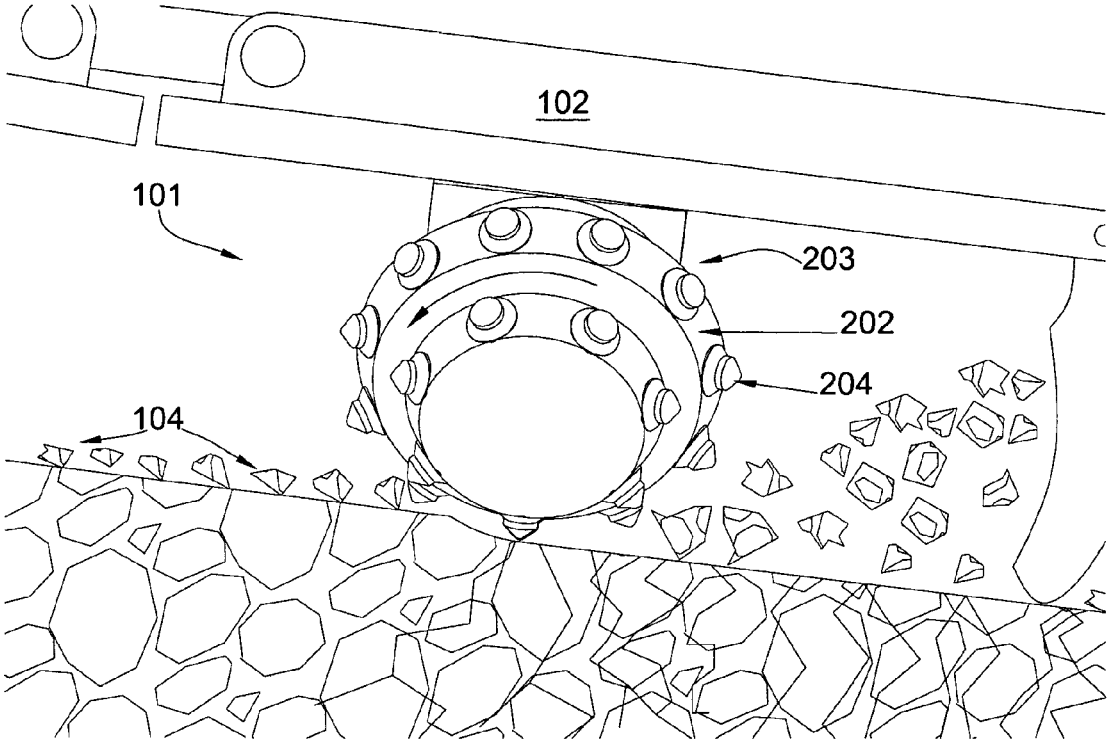
FIG. 2 is a perspective diagram of an embodiment of a roller assembly degrading a formation.

FIG. 2 is a perspective diagram of an embodiment of a roller assembly 101 degrading a formation 104. The roller assembly 101 comprises a conical body 202 with cutting elements 203 that are radially positioned in multiple rows along an outer surface of the conical body 202. The cutting elements 203 further comprise an impact tip 204 adapted to engage the formation 104. The conical body 202 is rotationally supported by an axle (not shown in the figure). The cutting elements 203 engage the surface at the impact tip 204. The conical body 202 and the cutting elements 203 may comprise or be coated with a hard material to prevent wear.

The impact tip 204 may comprise a super hard material bonded to a cemented metal carbide substrate. The superhard material may comprise a conical shape with a fairly sharp apex, about 0.050 to 0.150 degree radius. In some embodiments, the superhard material is thicker than the substrate from the apex to an interface bonding them together. A side wall of the conical shape of the superhard material may be about 45 degrees. The superhard material may diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, non-metal catalyzed diamond, cemented metal carbide, chromium, titanium, aluminum, tungsten, or combinations thereof. The super hard material may be a polycrystalline structure with an average grain size of 10 to 100 microns.

Figure 3:
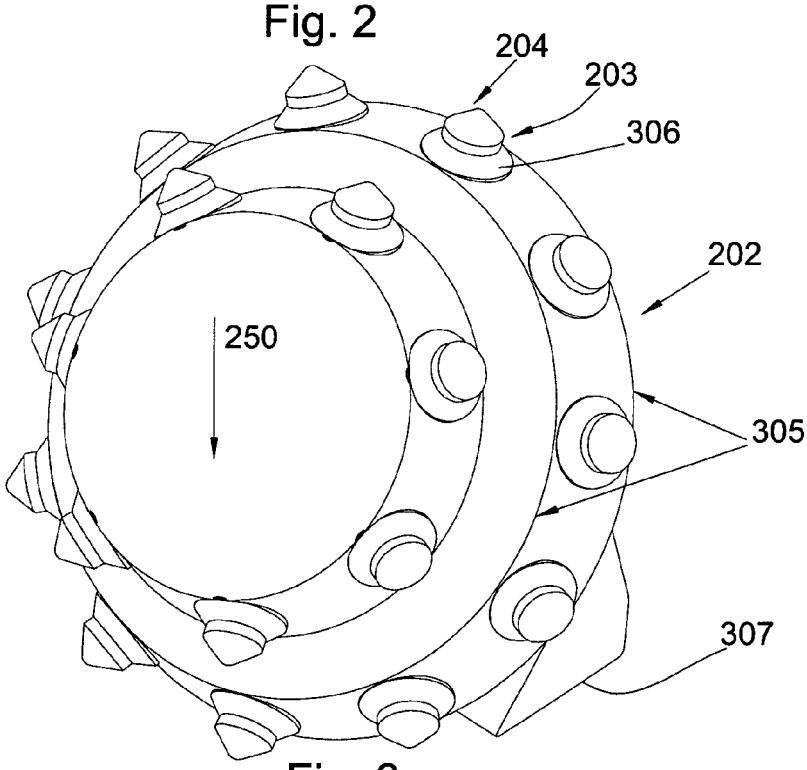
FIG. 3 is a perspective diagram of an embodiment of a roller assembly.

FIG. 3 is a perspective diagram of an embodiment of a roller assembly 101 with a base 307. The roller assembly 101 comprises cutting elements 203. The pointed inserts 203 comprise a carbide bolster 306 attached to an impact tip 204 and is press fit into or bonded to the body 202. Weight from the trenching boom is applied in the direction of the arrow 250 loading the cutting elements 203 as the roller moves along the formation. Preferably, each insert periodically penetrates into the formation and fractures it. Because the roller is skewed, the roller will catch the formation's fragments and push out of the trench where they can be deflected off to the trench's side. Ideally, the bolsters comprise a larger diameter than the substrate, effectively bolstering the substrate when loaded. The conical shape of the superhard material also bolsters the apex. Thus, with the geometries of the bolster and superhard material, each tip is very well supported, especially for extremely hard formation. Also, each insert is substantially loaded vertically along this well supported path, reducing bending moments typically found in the prior art.

Figure 4:
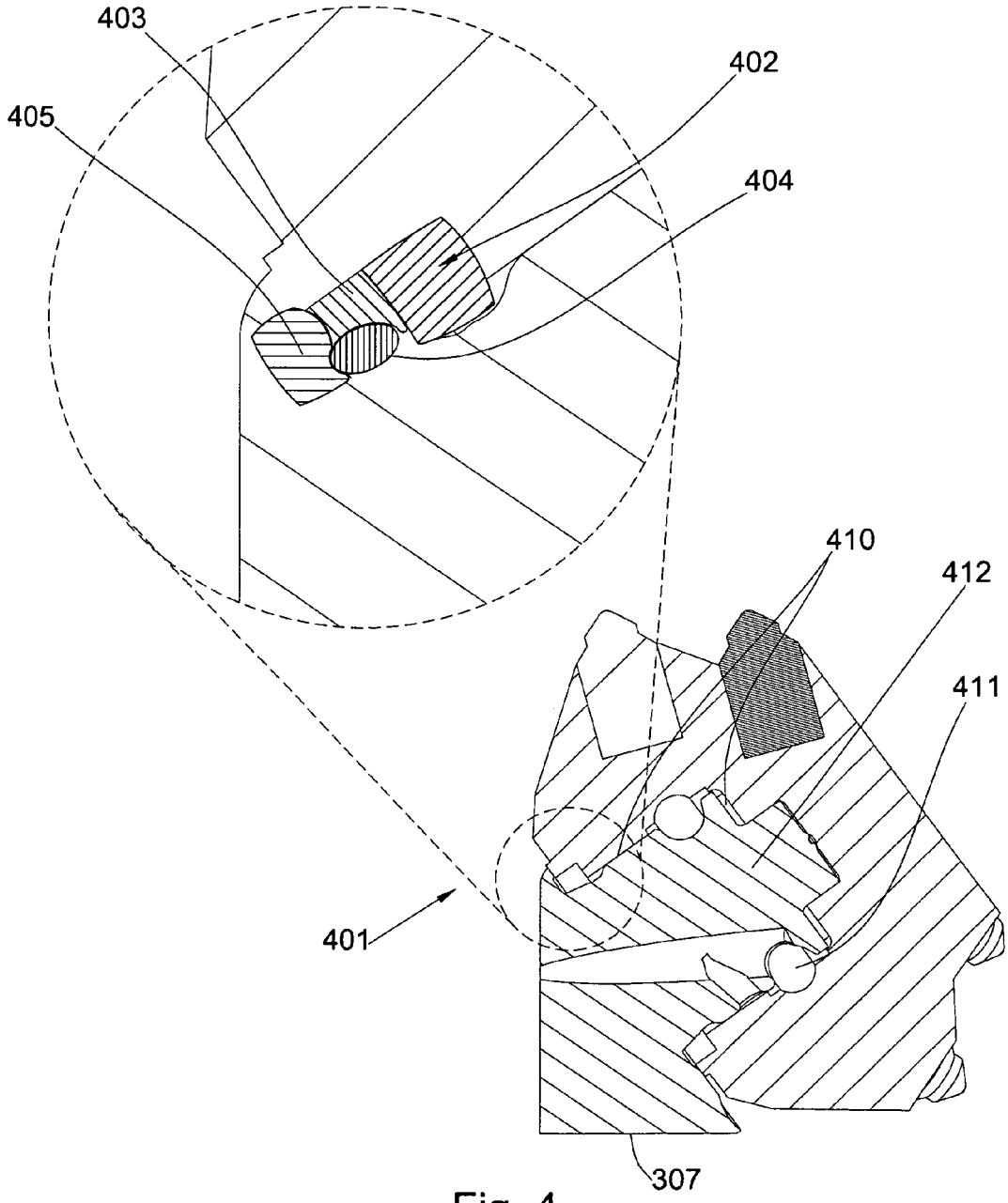
FIG. 4 is a cross-sectional diagram of an embodiment of a roller assembly.

FIG. 4 is a cross-sectional diagram of an embodiment of a roller assembly 101. The roller assembly 101 comprises a metal-to-metal seal assembly 401 and a bearing assembly 411. The seal 401 is disposed on a base end of the axle 412 and intermediate the axle 412 and an inner surface of the body 202. The axle 412 may be positioned at an angle of 25 to 55 degrees with respect to a chain link 102 of the trenching machine. The axle may also define the skewing position of the roller assembly. The seal 401 comprises a rotating metal ring 402 disposed in the inner surface of the body, a static metal ring 403, a backup ring 405 and an o-ring 404. The backup ring 405 may prevent the rotation of the metal ring 403 and keep it stable. The metal ring 402 may experience a compressive force while the roller assembly 101 is in operation. The o-ring 404 may push the static ring 403 towards ring 402. This mechanism may keep the gap between the ring 403 and 402 very small thereby forming a tight seal. The seal 401 may prevent dirt and debris from entering inside the body 202 of the roller assembly 101.

The bearing assembly is disposed intermediate the axle 412 and the inner surface of the body 202. The bearing assembly may comprise ball bearings, roller bearings, ball-thrust bearings, deep-groove ball bearings, taper roller bearings, roller thrust bearings, or combinations thereof. The bearing assembly 411 may keep the axle 412 and the rotating body 202 together. The bearing assembly 411 may further comprise a wear resistant coating disposed on the axle 412, the inner surface of the body 202, or combinations thereof. The coating may comprise Mo, Co, Fe—Si, Cr, self-fusing alloys, FeB, Fe—Si, SiC, cemented metal carbides, TiN, nitrides, polycrystalline ceramics, polycrystalline diamond, cubic boron nitride, or combinations thereof. Most of the load may be carried by a load zone 410 of the axle 412. This may decrease the loading through the bearing assembly 411.

Figure 5:
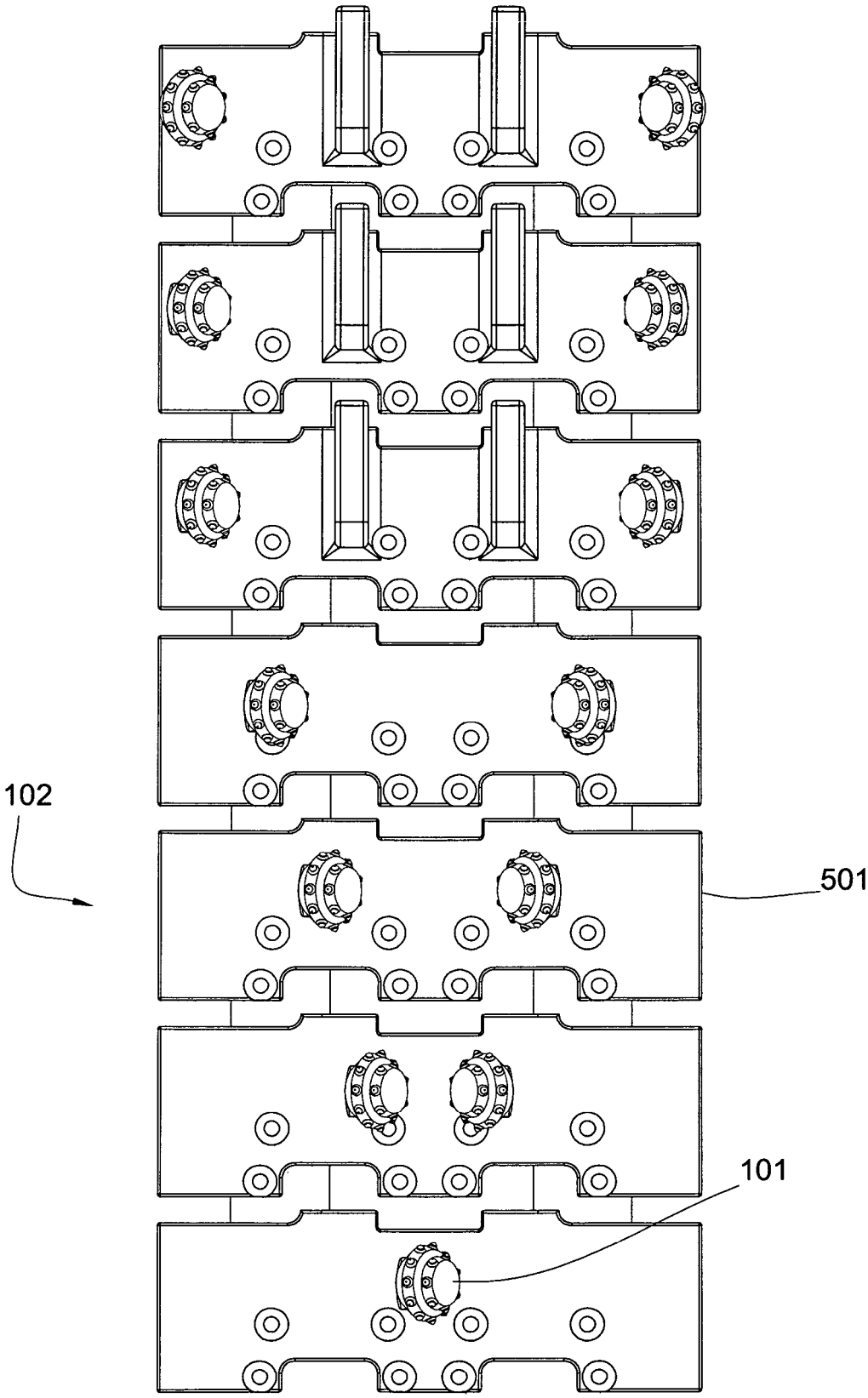
FIG. 5 is a perspective diagram of an embodiment of a plurality of roller assemblies attached to the chain of a trenching machine in a chevron pattern.

FIG. 5 is a perspective diagram of an embodiment of a plurality of roller assemblies 101 attached to the chain 102 of the trenching machine. A chain link 501 may comprise either a single roller assembly 101 or a plurality of roller assemblies 101 facing each other. The plurality of roller assemblies 101 in each chain link are skewed with respect to each other. The roller assemblies 101 located towards the edge of the links may protect the links' edges while trenching. In some embodiments, the inserts of the roller assembly may extend beyond the edges to form the trench's wall. In some embodiments, there may be paddles or other devices attached to the chain to help remove debris from the trench.

Figure 6:
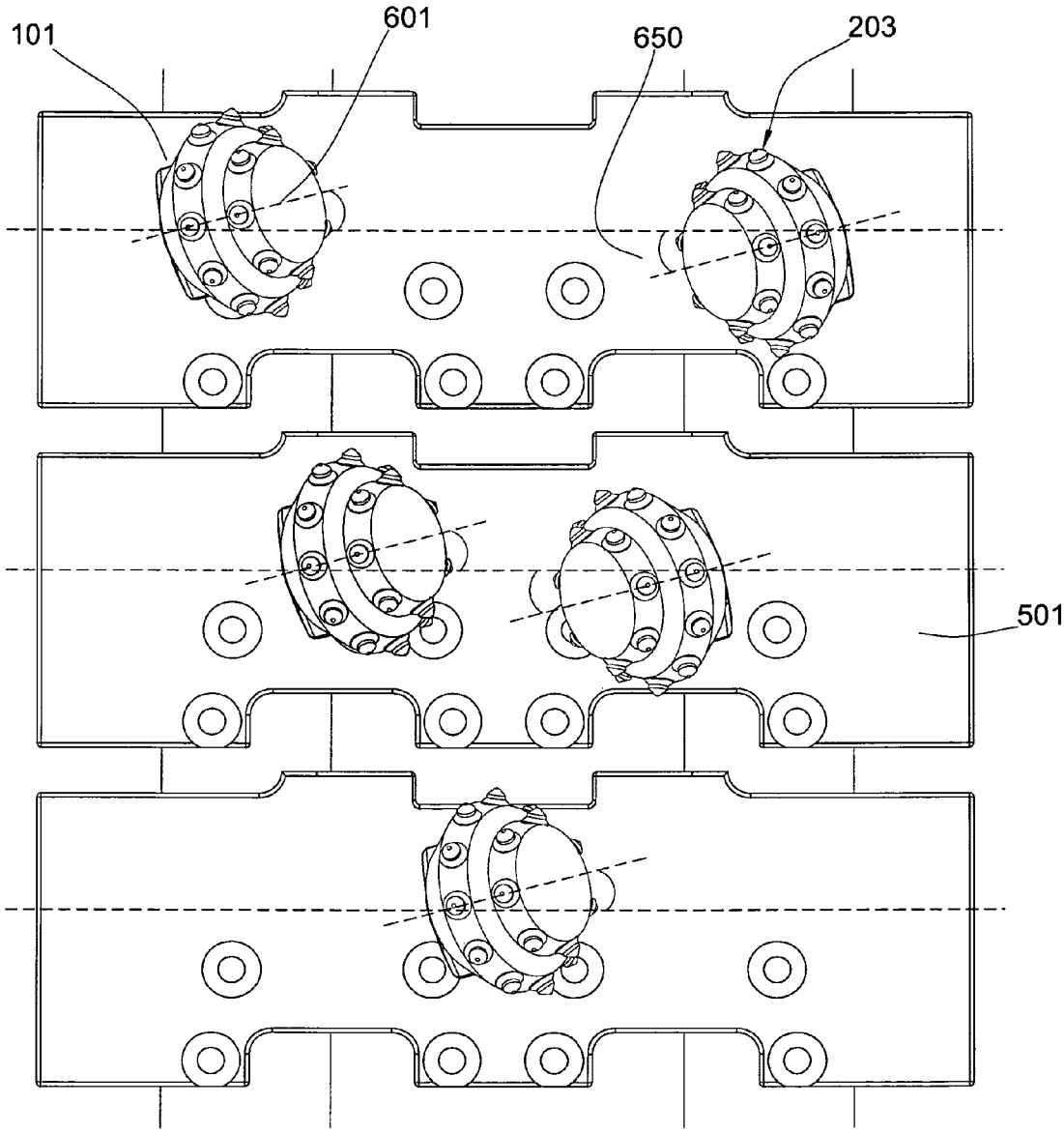
FIG. 6 is a perspective diagram of another embodiment of a plurality of roller assemblies attached to the chain of a trenching machine.

Referring to FIG. 6, the roller assemblies 101 are adapted to rotate at a skewed angle 650. A center axis 601 of the conically shaped body 202 is horizontally skewed from an orientation of a chain link 501 of the trenching machine. The skewed roller assembly 101 may cut the formation and also drag debris out of the trench. Each roller assembly 101 may comprise multiple cutting elements 203 radially arranged in multiple rows along an outer surface of the body 202. The central axis may be skewed at an angle of 15 to 30 degrees from the horizontal orientation of the chain link 501 of the trenching machine. The rollers may be skewed at different angles. In some embodiments, there will be multiple roller assemblies located on different links (such as in a different chevron), but located in the same position (or close to it) of the link. The roller assemblies that are located in similar positions of the link may be skewed at different angles to increase the overall effectiveness of cutting and cleaning out the trench.

Figure 7:
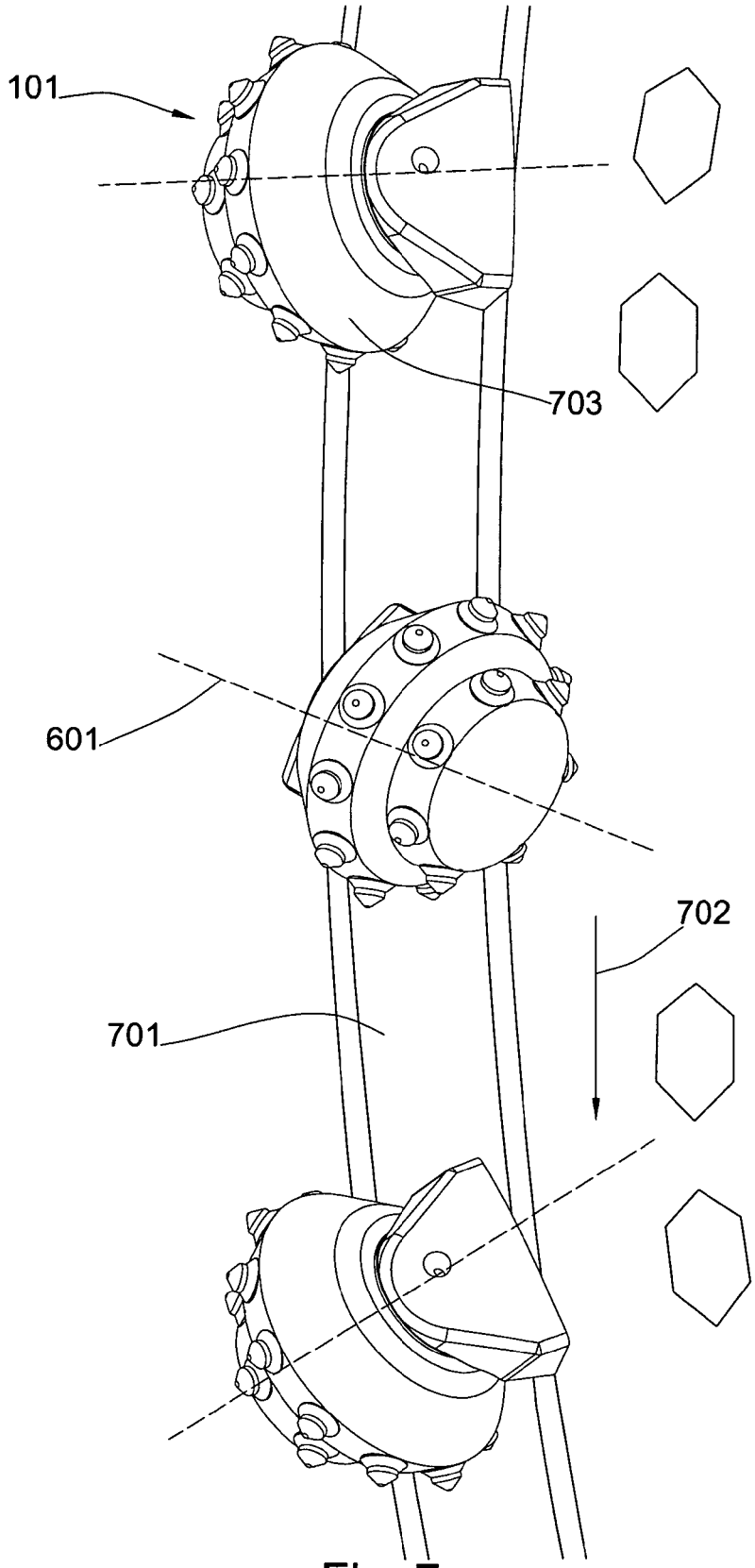
FIG. 7 is a perspective diagram of an embodiment of a plurality of roller assemblies mounted on a wheel trencher.

FIG. 7 is a perspective diagram of an embodiment of a plurality of roller assemblies mounted on a wheel trencher 701. The arrow 702 represents the direction of rotation of the wheel trencher 701. The central axis 601 of each roller assembly 101 is skewed at an angle. Each roller assembly 101 may be disposed in opposite orientation with respect to adjacent roller assembly.

Figure 8:
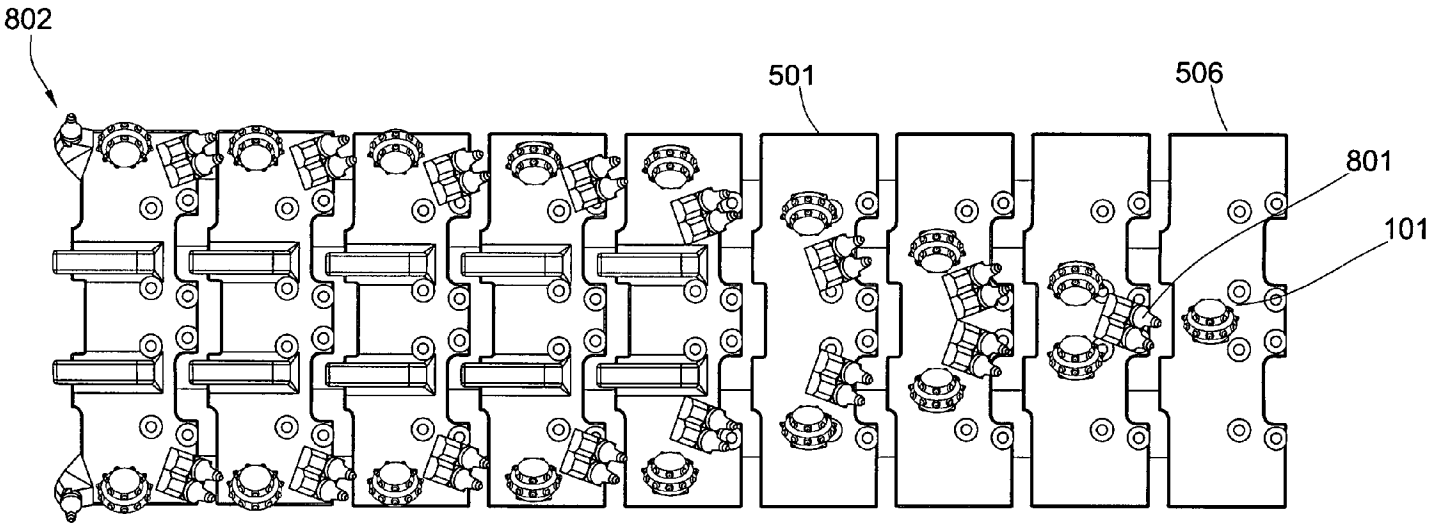
FIG. 8 is a perspective diagram of another embodiment of roller assemblies attached to the chain of a trenching machine.
Figure 9:
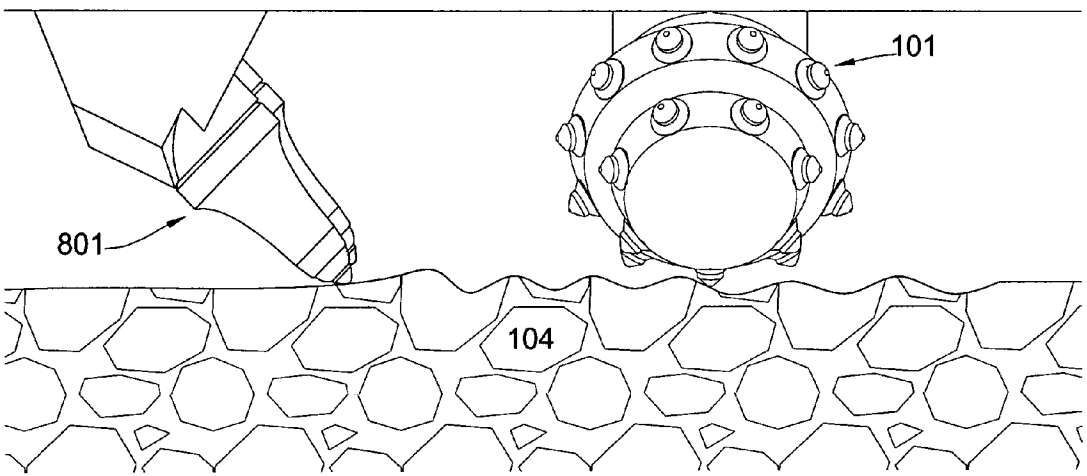
FIG. 9 is a perspective diagram of another embodiment of a roller assembly degrading a formation.

FIG. 8 is a perspective diagram of another embodiment of a plurality of roller assemblies 101 attached to a trenching chain. At least one of the roller assemblies 101 is followed by a pick assembly 801 also disposed in the chain. The pick assembly 801 may cut the formation behind the roller assembly 101 and help remove debris left behind. In some embodiments, the roller assembly may leave a wave pattern of high and low areas in the trench wall and floor. The pick assemblies may be orientated to cut the high areas of the wave pattern. In some embodiments, the skewed cutting action minimizes the high areas. The trenching machine may comprise a plurality of guide picks 802 disposed at the corners of the chain link. The guide picks 802 may prevent the deviation of the trenching chain while in operation. FIG. 9 discloses a roller assembly 101 with a pick assembly 801 positioned behind the roller assembly in operation.

Figure 10A:
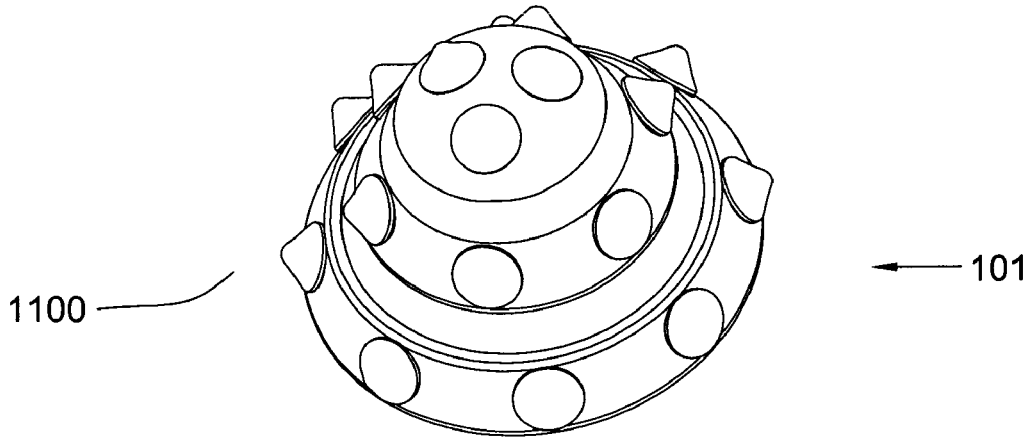
FIG. 10*a* is a perspective diagram of another embodiment of a roller assembly.
Figure 10B:
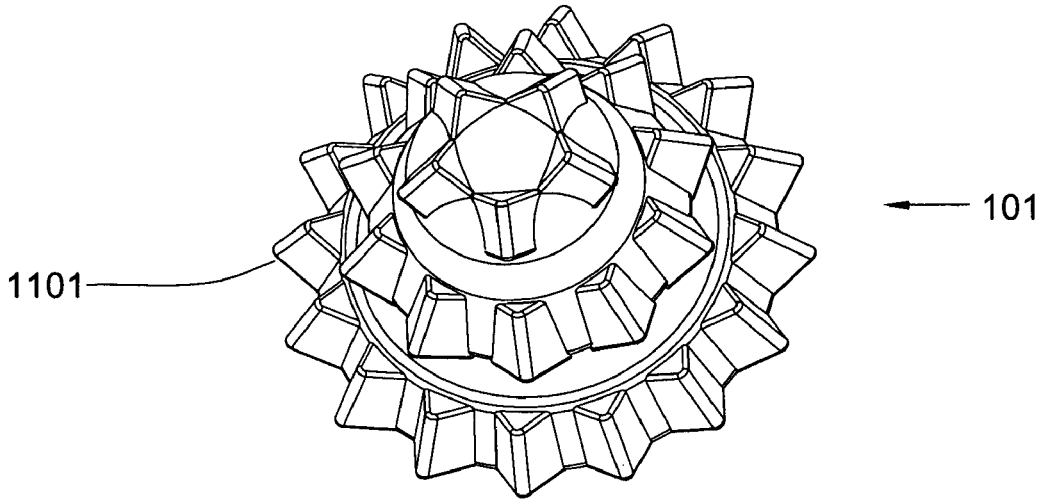
FIG. 10*b* is a perspective diagram of another embodiment of a roller assembly.
Figure 10C:
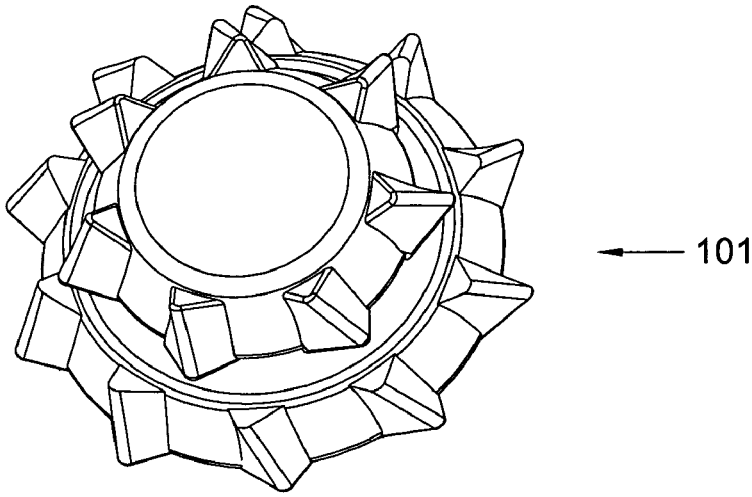
FIG. 10*c* is a perspective diagram of another embodiment of a roller assembly.

FIGS. 10*a-c* disclose different embodiments of a roller assembly 101. Roller assemblies 101 may comprise multiple cutting inserts radially arranged in multiple rows along an outer surface of the body or the cutting elements may be formed in the material of the roller assembly. The cutting elements may comprise a pointed geometry 1100. The pointed geometry may comprise a substantially conical shape with a round apex. Each cutting element may protrude out of the body at a different angle than another cutting element on the same body. In some embodiments, the cutting elements may be conical, rounded, chisel shaped 1101, or combinations thereof.

Figure 11:
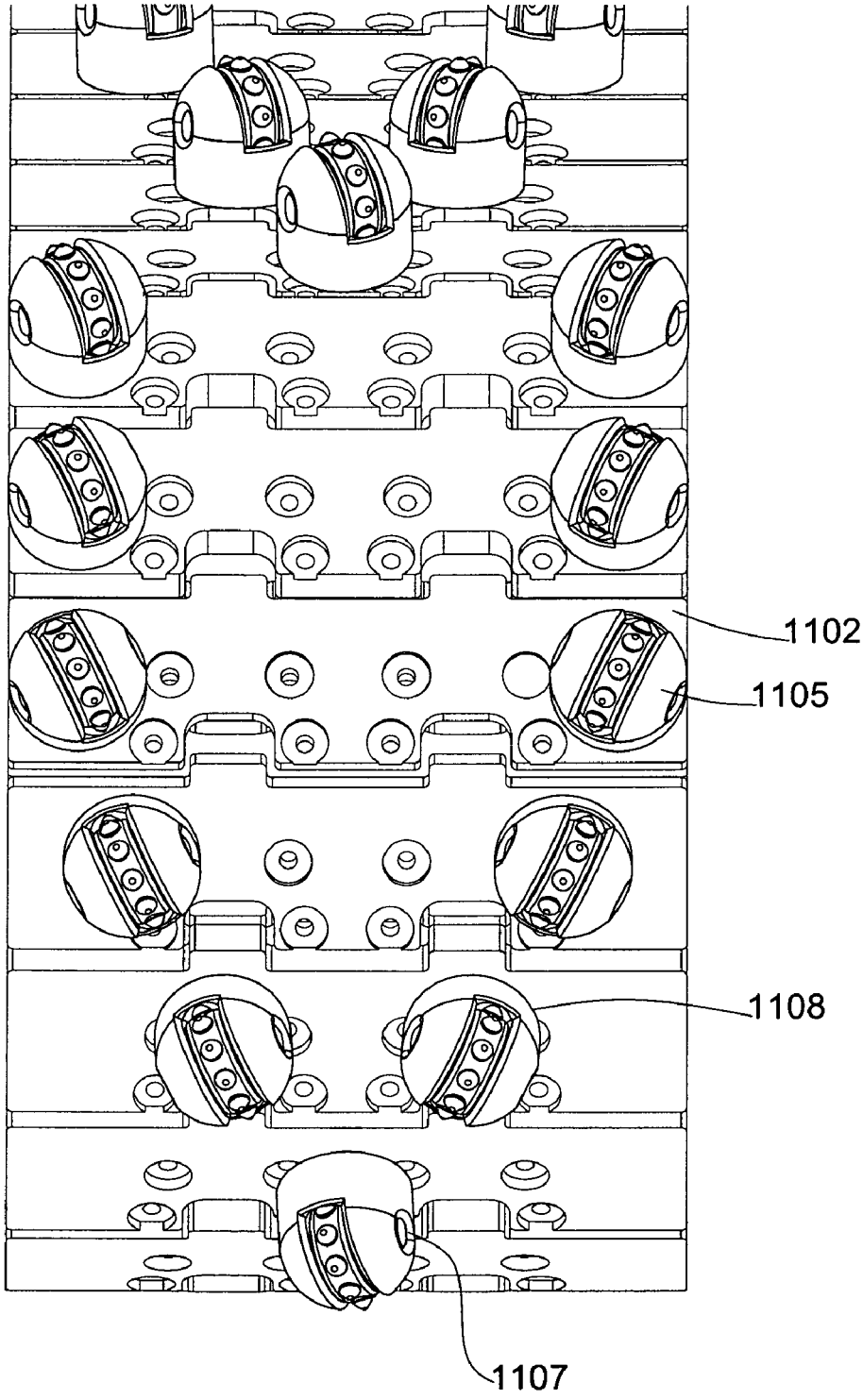
FIG. 11 is a perspective diagram of another embodiment of a plurality of roller assemblies attached to the chain of a trenching machine.

FIG. 11 is discloses a plurality of roller assemblies 1102 mounted on a chain of the trenching machine. The roller assembly 1102 comprises an axle 1107 supported on both ends. These roller assemblies may also be skewed with respect to the chain link, the chains, the travel direction of the chain, or combinations thereof. The roller assembly 1102 comprises a housing 1108 adapted to support the axle 1107. The housing 1108 comprises a tapered surface 1105. The tapered surface 1105 may reduce drag and wear on the housing 1108 of the roller assembly 1102.

Whereas the present invention has been described in particular relation to the drawings attached hereto, it should be understood that other and further modifications apart from those shown or suggested herein, may be made within the scope and spirit of the present invention.

What is claimed is:

1. A trenching machine for degrading natural and man-made formations, comprising;

at least one roller assembly comprising a body rotationally supported by an axle exteriorly mounted to a trenching chain or wheel configured to move the roller in a travel direction;

at least a portion of the body comprising a substantially conical shape;

the roller assembly is configured to rotate at a skewed angle with respect to the travel direction;

the axle defines the skew angle of the roller assembly; and the skewed angle is configured such that cutting elements, attached to the body, drag debris out of a trench formed by the rolling assembly.

2. The machine of claim 1, wherein the roller assembly comprises at least one metal-to-metal seal assembly disposed on a base end of the axle and intermediate the axle and an inner surface of the body.

3. The machine of claim 2, wherein the seal comprises a backup ring and an o-ring.

4. The machine of claim 1, wherein the roller assembly comprises a load carrying bearing assembly disposed intermediate the axle and an inner surface of the body.

5. The machine of claim 4, wherein the bearing assembly comprises ball bearings, roller bearings, ball-thrust bearings, deep-groove ball bearings, taper roller bearings, roller thrust bearings, or combinations thereof.

6. The machine of claim 4, wherein the bearing assembly comprises a wear resistant coating disposed on the axle, the inner surface of the body, or combinations thereof.

7. The machine of claim 6, wherein the coating comprises Mo, Co, Fe—Si, Cr, self-fusing alloys, FeB, Fe—Si, SiC, cemented metal carbides, TiN, nitrides, polycrystalline ceramics, polycrystalline diamond, cubic boron nitride, or combinations thereof.

8. The machine of claim 1, wherein the roller assembly comprises multiple cutting elements radially arranged in multiple rows along an outer surface of the body.

9. The machine of claim 8, wherein the cutting elements comprise a pointed geometry.

10. The machine of claim 9, wherein the pointed geometry of the cutting element comprises a substantially conical shape with a round apex.

11. The machine of claim 10, wherein the cutting element comprises a polycrystalline diamond body bonded to a cemented metal carbide substrate, and the diamond body is thicker than the carbide substrate.

12. The machine of claim 1, wherein at least one of roller assemblies is followed by a pick also disposed in the trenching chain.

13. The machine of claim 12, wherein the picks are adapted to contact the formation after the roller assembly.

14. The machine of claim 1, wherein the roller assembly comprises a chevron pattern comprising a plurality of roller assembly disposed in a single link of the trenching chain facing each other.

15. The machine of claim 1, wherein the axle is positioned at an angle of 25 to 55 degrees with respect to a chain link of the trenching machine.

16. The machine of claim 1, wherein at least one cutting element protrudes out of the body at a different angle than another cutting element on the same body.

17. The machine of claim 1, wherein a center axis of the conically shaped body is horizontally skewed from an orientation of a chain link of the trenching machine.

18. The machine of claim 17, wherein at least two bodies are skewed with respect to each other.

* * * * *